US008851953B2

(12) United States Patent
Oschuetz et al.

(10) Patent No.: US 8,851,953 B2
(45) Date of Patent: Oct. 7, 2014

(54) BUILDING BLOCK SYSTEM WITH MOVEABLE MODULES

(75) Inventors: Leonhard Oschuetz, Weimar (DE); Wolfgang Sattler, Schwaebisch Gmuend (DE)

(73) Assignee: Kinematics GmbH, Leipzig (DE)

( * ) Notice: Subject to any disclaimer, the term of this patent is extended or adjusted under 35 U.S.C. 154(b) by 153 days.

(21) Appl. No.: 13/548,611

(22) Filed: Jul. 13, 2012

(65) Prior Publication Data

US 2013/0183882 A1 Jul. 18, 2013

Related U.S. Application Data

(63) Continuation of application No. PCT/EP2011/050598, filed on Jan. 18, 2011.

(30) Foreign Application Priority Data

Jan. 22, 2010 (DE) ..... 10 2010 005 584
Nov. 30, 2010 (DE) ..... 10 2010 062 217

(51) Int. Cl.
*A63H 33/04* (2006.01)

(52) U.S. Cl.
CPC ..... *A63H 33/042* (2013.01)
USPC ..... 446/91; 446/85; 446/124; 446/125; 446/484

(58) Field of Classification Search
CPC ..... A63H 33/042; A63H 33/086
USPC ..... 446/90–91, 102, 175, 124–125, 85
See application file for complete search history.

(56) References Cited

U.S. PATENT DOCUMENTS

| | | | | |
|---|---|---|---|---|
| 6,454,624 | B1 * | 9/2002 | Duff et al. | 446/91 |
| 6,575,802 | B2 * | 6/2003 | Yim et al. | 446/91 |
| 6,585,553 | B1 * | 7/2003 | Fetridge et al. | 446/91 |
| 6,636,781 | B1 | 10/2003 | Shen et al. | |
| 7,747,352 | B2 | 6/2010 | Raffle et al. | |
| 7,942,717 | B2 * | 5/2011 | Chou | 446/91 |
| 8,221,182 | B2 * | 7/2012 | Seymour et al. | 446/91 |
| 2003/0040249 | A1 * | 2/2003 | Yim et al. | 446/91 |
| 2003/0040250 | A1 * | 2/2003 | Yim et al. | 446/91 |
| 2006/0134978 | A1 | 6/2006 | Rosen et al. | |
| 2010/0311300 | A1 * | 12/2010 | Hansen et al. | 446/91 |

FOREIGN PATENT DOCUMENTS

| | | | |
|---|---|---|---|
| CN | 201 067 636 | Y | 6/2008 |
| DE | 296 10 158 | U1 | 10/1996 |
| EP | 1 287869 | B1 | 3/2003 |
| WO | WO 2004/062759 | A1 | 7/2004 |
| WO | WO 2009/047225 | A1 | 4/2009 |

* cited by examiner

*Primary Examiner* — William Brewster
*Assistant Examiner* — Alex F. R. P. Rada II
(74) *Attorney, Agent, or Firm* — Von Rohrscheidt Patents

(57) ABSTRACT

The invention relates to a building block system having modules that can be plugged together, wherein electronic and mechanical components required for motion and control are provided in the modules. The object of the invention is to provide a building block system, which facilitates constructing mobile models from simple building blocks. According to the invention, the object is achieved by a building block system having movable modules, wherein the building block system includes at least one energy module, at least one control module having a micro-controller, at least one movement module having an integrated servo motor, and a plurality of connection modules that can be randomly connected with each other, wherein the modules are connectable through plug connections enabling current flow between adjacent modules.

16 Claims, 5 Drawing Sheets

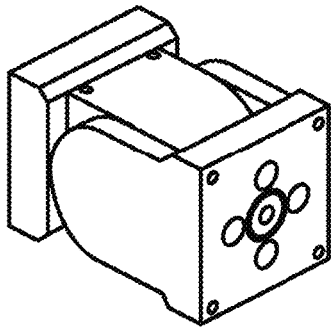
FIG 5.1
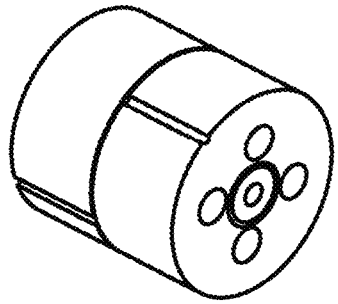
FIG 5.2
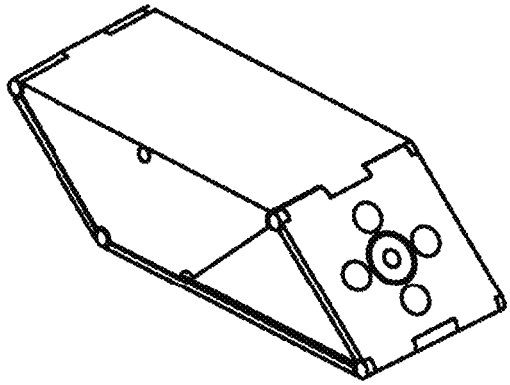
FIG 5.3
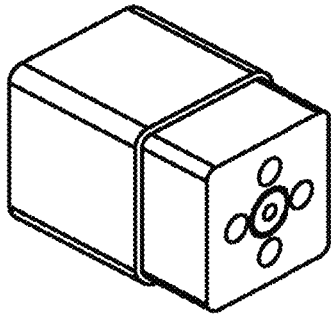
FIG 5.4
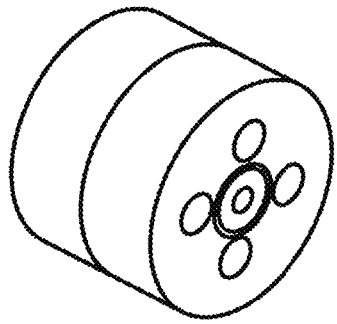
FIG 5.5

BUILDING BLOCK SYSTEM WITH MOVEABLE MODULES

RELATED APPLICATIONS

This application is a continuation of PCT/EP2011/050598, filed on Jan. 18, 2011, claiming priority from German Patent Application DE 10 2010 005 584.0, filed on Jan. 22, 2010, and from German Patent Application DE 10 2010 062 217.6, filed on Nov. 30, 2010.

FIELD OF THE INVENTION

The invention relates to a building block system with movable modules. The building block system is a toy that facilitates assembling movable and interactive objects. The invention is preferably usable as a creative toy for children in the age group between 5 and 13 years.

Children that use the building block toy experience interactions between type of configuration, movement and specific energy consumption. The building block system renders robotics, movement and energy technology intuitively comprehensible. It is suitable as a teaching aid for schools and nursery schools and also for personal use.

BACKGROUND OF THE INVENTION

Beginnings of so-called experimental computing kits have already been known since 1987/1988 at Fischer Technik. At Lego, recently, robotics kits like Cyber Master with CD ROM animation and in 1998 the Mind Storm RCX with an 8-Bit RAM processor were developed. In the year 2006, the Mind Storm RCX was replaced by the Mind Storm NXT with a 32 Bit RAM processor. With these developments, the kit manufacturers have put an end to classic building block kits. In spite of these tendencies, there is also an opposite trend: a plurality of good quality and simple basic wood building block kits goes back to the basics of these kits and thus to free playing with shapes.

In particular for teaching purposes, children shall be exposed by digital manipulatives through so-called playful learning to facts which are presently considered to be too complex for their age. Thus, children shall be given tools and environments in which they can develop dynamic systems.

A product series is known as LEGO Mind Storm which includes a programmable LEGO block and electric motors, sensors and LEGO technique components. Thus, robots and other autonomous interactive systems can be configured and subsequently programmed through a graphic user interface at a PC. Systems of this type designated as "program and play" are based on parameter values. Thus, their movements can be changed very easily and adjusted precisely. Often these parameter systems are modeled after professional development tools and thus also facilitate designing more complex systems. However, systems of this type differ from one another with respect to their respective interface design and the manner how movements of a model are provided. Therefore, new users have to make an effort to learn the system. Thus, it is disadvantageous in particular that the actual generation of the movement sequence is completely decoupled from the model that is built.

In U.S. Pat. No. 7,747,352 B2, a game is described that is known as Topobo which includes a 3D building block system with an installed kinetic storage module which can record movements and play them back. It includes a total of ten basic shapes which can be assembled in many different ways.

From U.S. Pat. No. 6,636,781 B1, a control of modules of a toy building block set is known in which modules can be moved by actuators. Identical modules can be combined which perform rotating movements.

Furthermore, EP 1 287 869 B1 describes a modular system for producing a toy robot through which a toy can be configured by assembling plural identical modules. The modules can perform a rotating movement and are connected with one another through connecting plates. The connecting plates facilitate a mechanical and electrical connection between the modules.

In these assemblies, it is detrimental that only identical modules can be combined and the modules only perform rotating movements.

A controllable toy robot is known from DE 296 10 158 U1, wherein the toy robot includes modules in which electronic and mechanical components are included which are required for movement and control. Besides the modules, the robot includes so-called forming components, like lateral-, base-, and cover-plates. The components can be assembled, wherein the electrical connection is provided through wires which protrude from the modules. Axles, sensors and similar are run out of the side plates.

BRIEF SUMMARY OF THE INVENTION

Thus, it is an object of the invention to provide a building block system as recited supra through which motion capable modules can be configured from simple modules, wherein rotating movements and also linear movements shall be implemented through the modules and the connection of the modules shall be provided through simple assembly without requiring additional process steps.

The object is achieved according to the invention with a building block system including plug connectable modules, wherein electronic and mechanical components that are required for movement and control are arranged in the modules, wherein the building block system includes at least one energy module, at least one control module with a micro controller and at least one movement module with an integrated servo motor which are random connectable with one another, wherein the modules are connectable through plug connectors which also facilitate current flow between adjacent modules, wherein at least the at least one movement module and the at least one energy module are configured independently from one another. Advantageous embodiments are defined in the dependent claims.

The building block toy system includes at least one energy module which typically includes an accumulator, at least one control module with a micro-controller, at least one movement module with integrated servo motor and plural connection modules. All modules are randomly connectable with one another. Besides assembling all types of models, the users can associate particular movement- and behavioral patterns with their creations. When assembled, all models, creatures, animals and robots can be brought to life.

A simple plug connector principle facilitates data- and current flow between all active and passive components. This concatenation facilitates a plurality of configured models and movement paths.

The kit includes numerous advantages; among these are in particular:

The movement module is an active movement drive in itself and on the other hand the movement module controls additional drives for other models through a data and power plug-in connection.

It is possible that at least one movement module and at least one energy module transmit power and data through a plug-in connection in assembled condition in order to provide a movement capable model without having to use passive elements.

Changing position and arrangement of the modules relative to one another facilitates a movement module with two integrated linked motion components. Thus, the assembled model is kept interconnected. The connection surfaces do not move relative to one another. The movements of the models of the building block kit are generated in the movement modules which change their shapes.

The movement modules are pluggable at a 90° angle offset from one another and thus generate different movement forms.

BRIEF DESCRIPTION OF THE DRAWINGS

Embodiments of the invention are subsequently described in more detail based on drawing figures, wherein:

FIGS. 5.1-5.5 schematically illustrate embodiments for link modules;

DETAILED DESCRIPTION OF THE INVENTION

Figure 1:
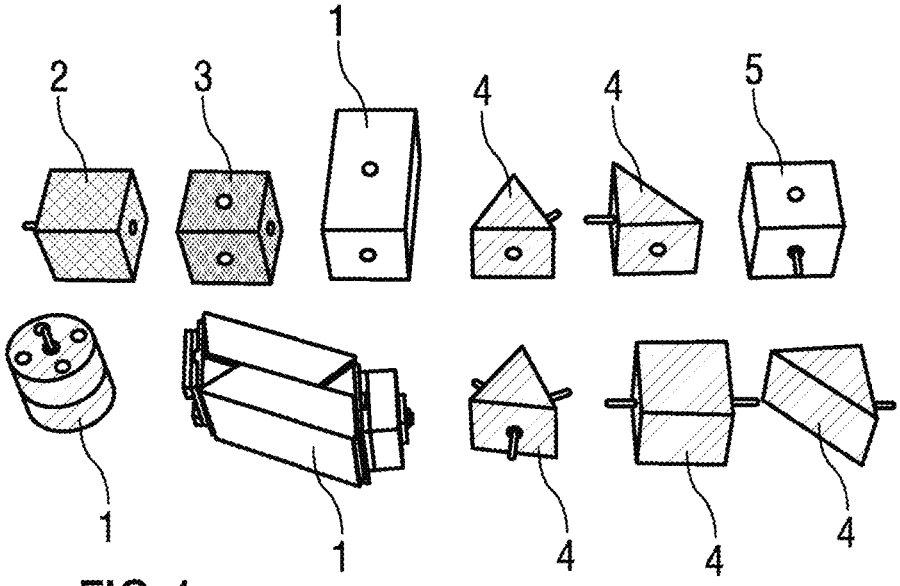
FIG. 1 schematically illustrates an overview of the modules of the building block system.

Equivalent components are provided in all figures with like reference numerals.

The system includes controlling, connecting, stopping, energy storing and kinematic modules. The assembled models form a movement network which has numerous movement variants depending on the arrangement and combination of the respective module types and shapes.

It is furthermore also possible that also smaller passive modules are plugged into the modules that have normal size. With these modules it is possible to configure additional shapes.

FIG. 1 illustrates the modules used, in particular:

Movement modules 1 which are moved by an integrated servo motor. In the illustrated case, two embodiments are provided: on the one hand side, configured as a cuboid which moves to form a parallelepiped, or on the other hand in the form of a cylinder building block which includes two partial cylinders that can rotate.

An advantageous embodiment provides that the movement modules are configured with lithium ion accumulators. An integrated on/off button at the movement module interrupts the power supply for all connected movement modules and at itself. It is also possible to arrange a micro-controller in the movement module.

Control modules 2 respectively including a micro-controller. All six lateral surfaces of a cuboid module are configured with plug sockets through which movement information can be put out.

Energy modules 3 which are used as power supplies for the movement modules. Through an on/off button, the current flow and thus the movement process can be turned on and off. The modules are configured in cube or cuboid shape and include lithium ion batteries in their interiors. They represent the heaviest element and can simultaneously be used as a center module when building objects.

Connection modules 4 which can be configured as cubes, half-cubes, triangular prisms, cuboids or other geometric shapes, and which establish the connection between movement module, control module and energy module. They enable a player to configure models with higher complexity and thus facilitate unimpeded data- and power flow.

Stop modules 5 which, contrary to the remaining modules of the system do not support data flow but only current flow. They can therefore be used as movement blocking elements, thus plural movement sequences are facilitated within an object built that are independent from one another.

Figure 2:
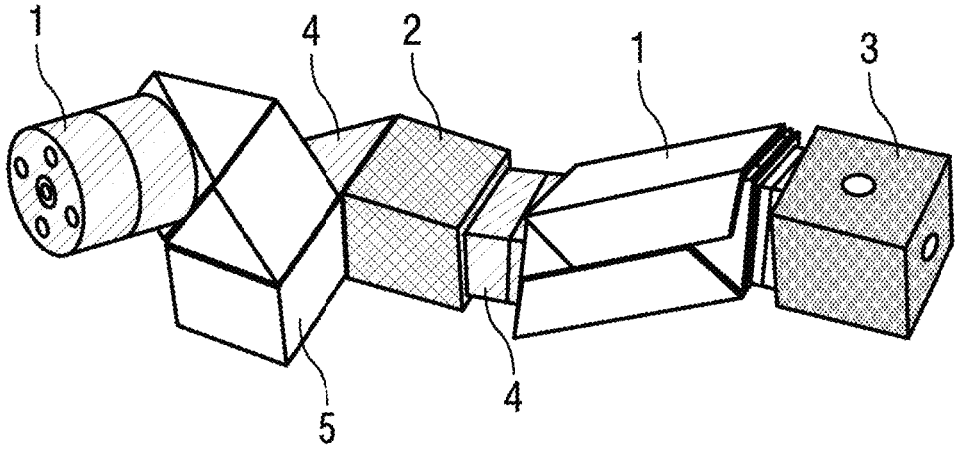
FIG. 2 schematically illustrates a mounted movement model.

FIG. 2 illustrates a mounted model.

Plugging together a movement module 1 with few passive modules already facilitates four movement directions. In order to generate a movement, only the following are required: an energy module 3 which performs power supply and which includes an on/off button in order to turn the movement process on and off. A control module 2 puts out the movement information for a movement module 1. The first two modules 2 and 3 are passive elements, whereas the movement module 1 is an active element of the building block system. Herein the plug-in sequence of the particular modules does not matter. A movement is put out whenever the energy module 3 and the control module 2 are installed. This property of the plug-in system provides numerous combinations of the modules and lets the user experience numerous motion sequences in the three-dimensional space. Thus, a magnetic 90° twist plug assembly, employing interlocking socket connections is used which provides the plug connection with stability on the one hand side and which provides easy engagement during the twist process. Thus, an inner data flow between all modules is facilitated.

The size of the modules can be provided differently. A side surface of the modules of 40 mm×40 mm has proven useful. It is also possible to use the standard size of LEGO blocks (31.8 mm×31.8 mm or 39.75 mm×39.75 mm). Thus a fully compatible linking of the two building block systems is facilitated. For this purpose, an adapter building block is used which has holes for axles and connection elements in addition to the known knobs and holes.

The connection of the modules with one another is provided through a plug-in connection.

Figure 3:
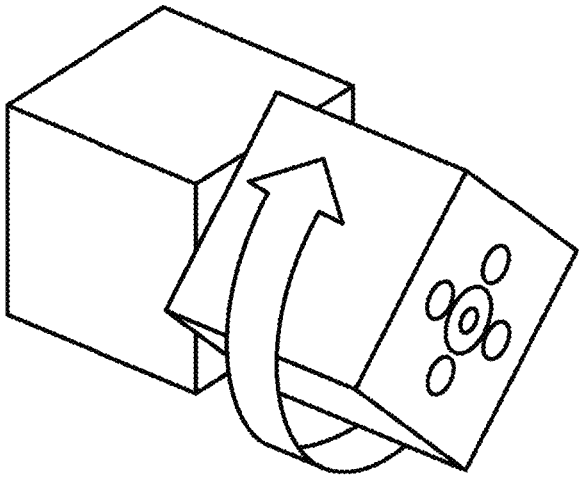
FIG. 3 schematically illustrates the function of the twist plug connection.

The 90° twist plug-in connection illustrated in FIG. 3 includes magnets and pin socket connections and facilitates a quick change of the module position. The support force is determined by magnets. Particular movement- and force influences can separate the magnets from one another and thus rotate the modules relative to one another. The connection keeps the modules together and provides stability to the configuration. Thus, it is provided that the modules do not kink or rotate relative to one another, also in the moving models. The modules engage in 90° steps and can be pulled apart easily in the 45° positions arranged therebetween.

Figure 4:
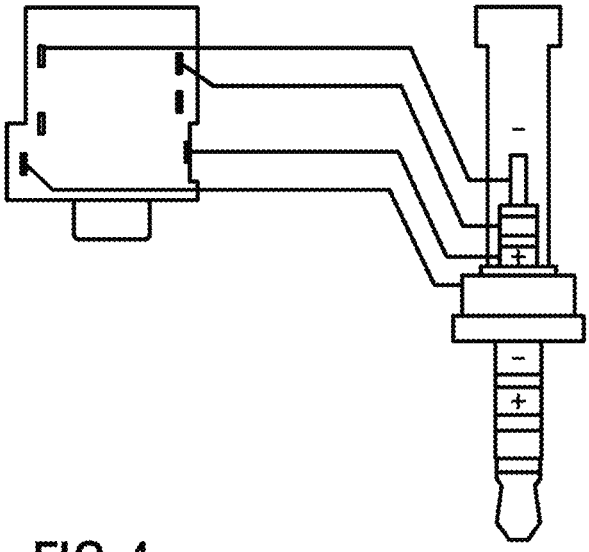
FIG. 4 schematically illustrates the plug component of a plug connection.

FIG. 4 illustrates the data- and power transmission through the plug-in connection. The power for the servo motor and the micro-controller is transmitted through a pin socket connection or two metal plugs. The contact surfaces of the plugs contact opposite contacts in the associated sockets. The data information for the sensor- and control signals can be additionally transmitted through the pin, two metal plugs or via Bluetooth. It is particularly advantageous that the plug connector, besides keeping the modules together, can simultaneously transmit the power and data flow.

The plug in connections include the male component illustrated in FIG. 4 with outward oriented support- and contact pins and a female component with inward oriented support- and contact openings. In the interior of the modules, there are conductor circuit boards which are electrically connected with the male or female portion of the plug connection. This facilitates simple assembly with a small number of components.

It is another option to distribute the plug connection over the module surfaces. The modules are thus kept together by various metal pins, contact pins, magnets and transfer the current and data flow.

An optional embodiment for a movement toy is a micro-controller module and three different movement modules.

FIG. 5 illustrates different embodiments for movement modules. FIG. 5.1 illustrates a pivot link module, FIG. 5.2 illustrates a rotating module, FIG. 5.3 illustrates a translatoric module, FIG. 5.4 illustrates a linear module, and FIG. 5.5 illustrates a rotation module.

The movement information for angle deflection and velocity is transmitted by a control module to the movement modules as soon as an energy module is plugged in. When a micro-controller is integrated into the movement module, each movement module can be controlled individually.

The energy module includes an accumulator. The accumulator provides power and includes a particular module in order to facilitate playful teaching. The accumulator thus facilitates playing with the balance, since the energy module is the heaviest component in the building block set. Besides the heavy nickel metal hydride accumulators, energy modules are advantageously configured with lithium ion accumulators in order to reduce weight and to increase accumulator capacity. In the described embodiment, two lithium ion accumulators with 3.7 V are connected in parallel and double the capacity. A step up converter brings the 3.7 V to 5 V operating voltage and supplies the micro controller and the movement modules with power. Through a USB charging- and protection circuit, the energy module is charged and protected against shorting. In addition, the energy module includes an on/off switch in order to control the current circuit.

A commercially available servo module is used as a drive for the movement modules. Through pulse width modulation [PWN], the servo module is controlled by the micro controller and can be mounted in a simple manner as a compact drive unit.

A building block set with energy modules is a special version, wherein the energy modules obtain power from renewable sources. It enables kids and teenagers to build small power plants which provide current for illumination and movement objects. The set includes energy producing and energy consuming modules. The generator- and accumulator-modules and solar wind turbine, hand crank, rotation and cable modules are power producing modules. On the other hand side the movement and illumination modules are energy consuming elements. The geometric modules are based on pedagogic basic shapes like cubes, cuboids, cylinders, and triangular prisms. The users experience the contexts of power generation and specific energy consumption of their moving and illuminating models in a playful manner. The building block system renders the topic of regenerative energy conversion comprehensible in a lively and intuitive manner for kids based on their own creations.

Figure 6:
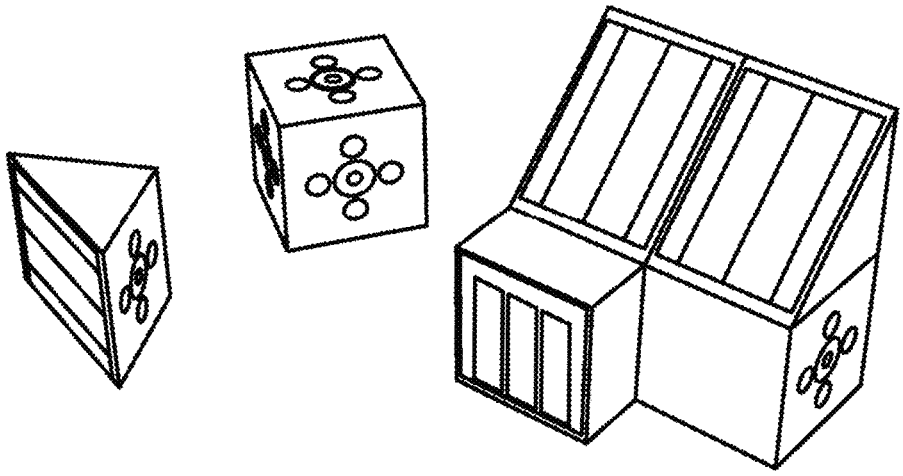
FIG. 6 schematically illustrates an assembly with solar modules.

FIG. 6 illustrates an embodiment for configuring and using solar modules.

The building block system can be provided with plural interfaces.

Figure 7:
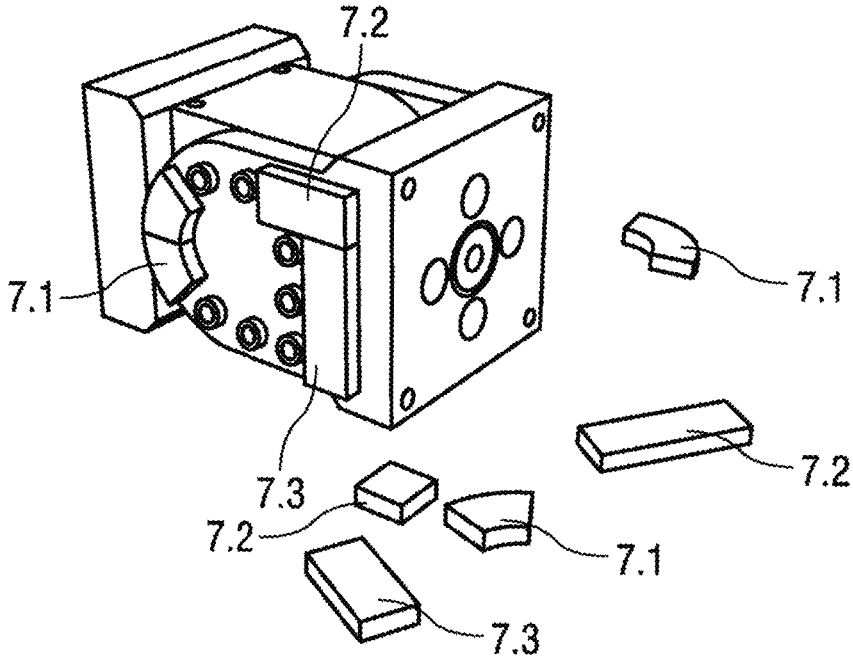
FIG. 7 schematically illustrates an embodiment of movement modules with particular building blocks inserted onto the modules.

FIG. 7 illustrates an embodiment in which particular building blocks are plugged into the movement modules and the movement parameters are thus defined. Thus, amplitude-, velocity- and deceleration-potentiometers are integrated in the movement module, wherein the parameters are changed by the brain module or directly at the movement module. Thus, the movement modules cam be programmed.

The arrangement facilitates child friendly manipulation of the movement parameters through simple embodiments. The amplitude building blocks 7.1, velocity building blocks 7.2 and the retardation building blocks 7.3 can be directly attached to the movement module. Through different velocity building blocks 7.2, a faster or slower movement of the link modules can be programmed. Among the amplitude building blocks 7.1, for example a building block with four rows of knobs can cause a rotation of 45° and a block with five knobs can cause a rotation of 36°. Each plug-in knob is provided with a color sensor. A retardation block 7.3 with a knob causes a time retardation of one millisecond in this embodiment. Thus, the programming is completely pluggable.

Figure 8:
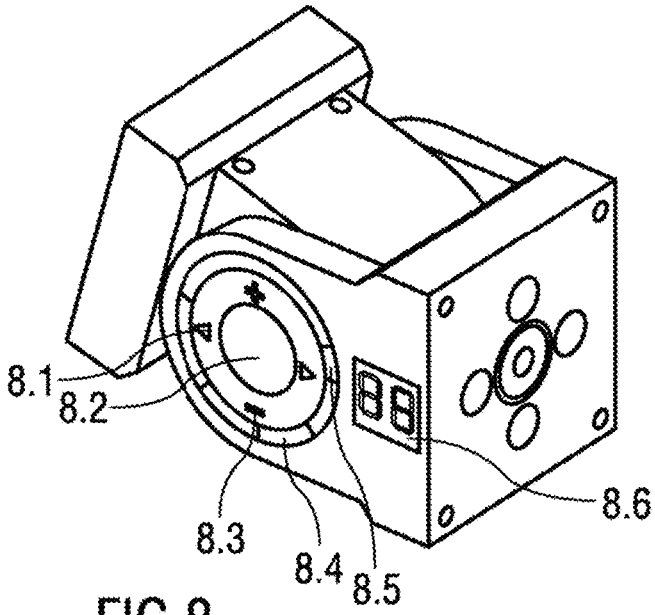
FIG. 8 schematically illustrates another embodiment of movement modules with particular components plugged into the movement modules.

Another embodiment is illustrated in FIG. 8. Thus, a basic movement of the model can be provided by moving the movement building blocks and can be simultaneously stored after the energy module was plugged in and the program button was pressed at the movement module. The basic movements of the movement modules are generated by hand. Thus, a maximum of two movement modules can be controlled by hand and changed. The start- and the end angle, the velocity and the retardation, this means which module moves first, is read out by a rotary potentiometer and stored in an EPROM chip. The stored movements can be subsequently performed directly.

The movement parameters which are initially still programmed intuitively can be subsequently changed through integrated amplitude-, velocity- and retardation-potentiometers and can be adapted to the movement model. The parameters can be changed easily, either through the control center at the brain module or through the control center at the movement module, which for example include integrated buttons, control slides, rotary potentiometers, sensors or a touch screen display. Thus, the program button of the movement module to be manipulated is pressed and the control center is regulated at the brain module or the movement module. Plural modules can also be changed simultaneously with respect to amplitude and velocity.

The control center also includes a seven-segment dot matrix, LED panel or touch screen display next to the input field, wherein the touch screen display additionally indicates the parameters and can provide a feedback regarding the manipulated data.

Figure 9:
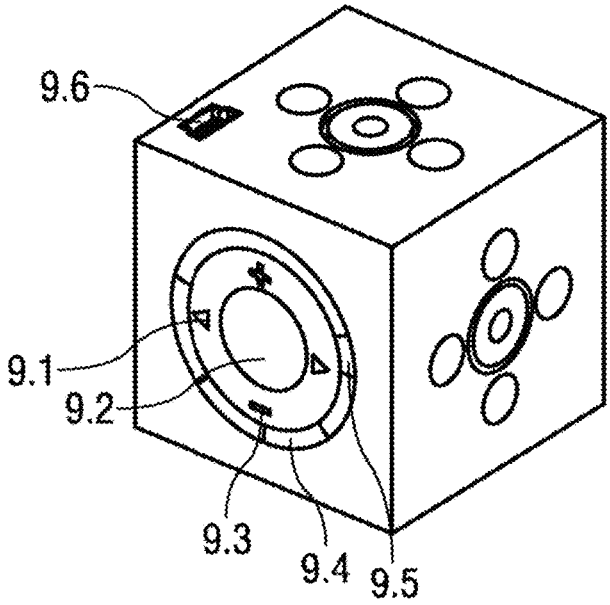
FIG. 9 schematically illustrates a brain module.

The brain module illustrated in FIG. 9 forms the thinking organ. It includes a micro controller and can change the movement parameters of all plugged in movement modules, synchronize them, display them or rhythmically retardation them. The brain module synchronizes all connected movement modules with the movement parameters which were changed in a module. The brain module forms the communication unit, evaluates the sensor data and controls all plugged in modules. It includes an amplitude display 9.1, a program button 9.2, a control center button 9.3, a velocity display 9.4 and a retardation display 9.5. The movement parameters can be secured externally through USB connections 9.6. Small sensor modules can be plugged into each movement module and change the movement module separately.

REFERENCE NUMERALS AND DESIGNATIONS

1 Movement module
2 Control module
3 Energy module
4 Connection module
5 Stop module
7.1 Amplitude block
7.2 Retardation block
7.3 Velocity block
8.1 Amplitude display
8.2 Program button
8.3 Control center button
8.4 Velocity display
8.5 Retardation display
8.6 7-segment display
9.1 Amplitude display
9.2 Program button
9.3 Control center button
9.4 Velocity display
9.5 Retardation display
9.6 USB connection

What is claimed is:

1. A building block system, comprising:

plug connectable modules, wherein electronic and mechanical components that are required for movement and control are arranged in the modules, wherein the building block system includes at least one energy module with an energy storage device, at least one control module with a micro controller and at least one movement module with an integrated servo motor which are random connectable with one another, wherein the modules are connectable through plug connectors which also facilitate current flow between adjacent modules, wherein flat lateral surfaces of modules are provided with plug connector elements of the plug connectors, wherein at least the at least one movement module and the at least one energy module are configured separate and independent from one another, and wherein the at least one movement module does not include an energy storage device.

2. The building block system according to claim 1, wherein data transmission is also provided through the plug in connection.

3. The building block system according to claim 1, wherein the building block system includes at least one stop module which only facilitates current flow between adjacent modules without data transmission.

4. The building block system according to claim 1, wherein the plug in connection is a twist plug in connection, and wherein the modules connected with one another interlock in 90° increments and are disengageable from one another in 45° increments arranged between the 90° increments.

5. The building block system according to claim 1, wherein the modules are configured with cube-, cylinder- or cuboid-shape.

6. The building block system according to claim 1, wherein the at least one movement module includes a servo motor, and wherein two integrated motion components that are linked together deform the at least one movement module when the servo motor is actuated.

7. The building block system according to claim 6, and wherein the at least one movement module is cuboid shaped, and wherein the cuboid changes its longitudinal dimension or is shifted into a parallelepiped when moved.

8. The building block system according to claim 1, wherein the at least one movement module includes two rotatable cylindrical components.

9. The building block system according to claim 1, wherein small passive modules are plugged into the modules.

10. The building block system according to claim 1, wherein at least one connection module is provided which is configured passive.

11. The building block system according to claim 1, wherein two movement modules from the group link module, rotation module, translatoric module, and linear module are provided.

12. The building block system according to claim 1, wherein building blocks are pluggable into the movement modules, and wherein the building blocks define movement parameters.

13. The building block system according to claim 12, wherein the movement parameters are variable directly at the at least one movement module.

14. The building block system according to claim 12, wherein the movement parameters are stored in the at least one movement module.

15. The building block system according to claim 12, wherein the pluggable building blocks actuate potentiometers which are arranged in interiors of the movement modules and which control an amplitude or a velocity or a retardation of the movement performed by the movement module.

16. The building block system according to claim 12, wherein the pluggable building blocks actuate potentiometers which are arranged in interiors of the movement modules and which control an amplitude and a velocity and a retardation of the movement performed by the movement module.

* * * * *